US005571347A

United States Patent [19]

Bergsma

[11] Patent Number: 5,571,347

[45] Date of Patent: Nov. 5, 1996

[54] HIGH STRENGTH MG-SI TYPE ALUMINUM ALLOY

[75] Inventor: S. Craig Bergsma, The Dalles, Oreg.

[73] Assignee: Northwest Aluminum Company, The Dalles, Oreg.

[21] Appl. No.: 304,511

[22] Filed: Sep. 12, 1994

Related U.S. Application Data

[63] Continuation-in-part of Ser. No. 224,485, Jan. 7, 1994, abandoned.

[51] Int. Cl.[6] ..... C22F 1/04

[52] U.S. Cl. ..... 148/550; 148/551; 148/552; 148/690; 148/694; 148/695; 148/700; 148/702; 148/415; 148/417; 148/418; 148/439; 148/440; 148/534; 148/535; 148/537; 148/542; 148/543; 148/544; 148/545; 148/546; 148/548; 148/549; 148/552; 148/553

[58] Field of Search ..... 148/550, 551, 148/552, 690, 694, 695, 700, 702, 415, 417, 418, 439, 440; 420/534, 535, 537, 542–546, 548, 549, 552, 553

[56] References Cited

U.S. PATENT DOCUMENTS

| | | | |
|---|---|---|---|
| 1,899,631 | 2/1933 | Norton | 420/549 |
| 1,952,048 | 3/1934 | Archer et al. | 420/534 |
| 2,336,512 | 12/1943 | Stroup | 420/542 |
| 2,821,495 | 11/1958 | Dulin | 420/537 |
| 3,236,632 | 2/1966 | Foerster | 148/415 |
| 3,573,035 | 3/1971 | Griffiths | 148/415 |
| 3,739,837 | 6/1973 | Wagstaff et al. | 164/444 |
| 4,113,472 | 9/1978 | Fister, Jr. et al. | 420/535 |
| 4,394,348 | 7/1983 | Hardy et al. | 420/542 |
| 4,525,326 | 6/1985 | Schwellinger et al. | 420/535 |
| 4,589,932 | 5/1986 | Park | 148/690 |
| 4,597,432 | 7/1986 | Collins et al. | 164/444 |
| 4,598,763 | 7/1986 | Wagstaff et al. | 164/472 |
| 4,693,298 | 9/1987 | Wagstaff | 164/486 |
| 4,735,867 | 4/1988 | Finnegan | 148/440 |
| 4,786,340 | 11/1988 | Ogawa et al. | 148/439 |
| 4,929,511 | 5/1990 | Bye, Jr. et al. | 420/548 |
| 5,123,973 | 6/1992 | Scott et al. | 148/690 |

FOREIGN PATENT DOCUMENTS

| | | | |
|---|---|---|---|
| 104139 | 8/1983 | European Pat. Off. . | |
| 2197074 | 3/1974 | France . | |
| 5950147 | 3/1984 | Japan . | |
| 60-155655 | 8/1985 | Japan . | |
| 60-248861 | 12/1985 | Japan | 420/545 |
| 1-287244 | 11/1989 | Japan . | |
| 1287244 | 11/1989 | Japan . | |
| 4-341546 | 11/1992 | Japan . | |
| 4341546 | 11/1992 | Japan . | |
| 6-2063 | 1/1994 | Japan . | |
| 6002063 | 1/1994 | Japan . | |

*Primary Examiner*—David A. Simmons
*Assistant Examiner*—Robert R. Koehler
*Attorney, Agent, or Firm*—Andrew Alexander

[57] ABSTRACT

Disclosed is an improved aluminum base alloy comprising an improved aluminum base alloy comprising 0.2 to 2 wt. % Si, 0.3 to 1.7 wt. % Mg, 0 to 1.2 wt. % Cu, 0 to 1.1 wt. % Mn, 0.01 to 0.4 wt. % Cr, and at least one of the elements selected from the group consisting of 0.01 to 0.3 wt. % V, 0.001 to 0.1 wt. % Be and 0.01 to 0.1 wt. % Sr, the remainder comprising aluminum, incidental elements and impurities. Also disclosed are methods of casting and thermomechanical processing of the alloy.

58 Claims, No Drawings

HIGH STRENGTH MG-SI TYPE ALUMINUM ALLOY

CROSS REFERENCE TO RELATED APPLICATIONS

This application is a continuation-in-part of U.S. Ser. No. 08/224,485, filed Apr. 7, 1994, now abandoned.

BACKGROUND OF THE INVENTION

The present invention relates to improved Mg-Si type aluminum alloys, and in particular to compositions and methods for production of improved Mg-Si type alloys.

Mg-Si type aluminum alloys such as 6XXX series aluminum alloys are widely used and favored for their moderately high strength, low quench sensitivity, favorable forming characteristics and corrosion resistance. 6XXX series alloys are increasingly attractive to industries such as transportation because of these well-known properties. Additional applications for 6XXX series alloys would be possible if higher strength levels could be achieved. Preferably, these strength levels would be achievable with or without deformation and without any significant decrease in working properties.

Various elements have been added to Mg-Si type alloys to improve their properties. For example, U.S. Pat. No. 2,336,512 discloses an aluminum base alloy containing 1 to 15% Mg, 0.1 to 5% Cu, or from 2 to 14% Zn, or from 0.3 to 5% Si or combinations of these. In addition, the alloy may contain manganese, chromium, titanium, vanadium, molybdenum, tungsten, zirconium, uranium, nickel, boron and cobalt. Beryllium is added to prevent dross formation and magnesium losses.

Japanese application No. 57-160529 discloses a high strength, high toughness aluminum alloy containing 0.9 to 1.8% Si, 0.8 to 1.4% Mg, 0.4 to 1.8% Cu, and containing at least two of 0.05 to 0.8% Mn and 0.05 to 0.35% Cr.

U.S. Pat. No. 1,952,048 discloses an aluminum-beryllium alloy containing from 0.025 to 1.0% beryllium, 0.1 to 1.0% silicon, 0.1 to 0.5% magnesium and 0.1 to 6.0% copper having improved hardness and age hardening properties.

Japanese application No. 59-12244 discloses a method for manufacturing a high strength aluminum alloy conductor containing 0.5 to 1.4 wt. % magnesium, 0.5 to 1.4 wt. % silicon, 0.15 to 0.60 wt. % iron, 0.05 to 1.0 wt. % copper, 0.001 to 0.3 wt. % beryllium, the remainder aluminum.

U.S. Pat. No. 4,525,326 discloses an aluminum alloy for the manufacture of extruded products, the aluminum alloy containing 0.05 to 0.2% vanadium, manganese in a concentration equal to ¼ to ⅔ of the iron concentration, 0.3 to 1.0% magnesium, 0.3 to 1.2% silicon, 0.1 to 0.5% iron, and up to 0.4% copper.

In spite of these references, there is still a great need for an improved aluminum base alloy having improved strength properties while maintaining high levels of elongation.

SUMMARY OF THE INVENTION

It is an object of the invention to provide an improved Al-Mg-Si alloy.

It is a further object of the invention to provide an improved 6XXX alloy.

It is another object of the invention to provide a 6XXX type alloy cast product having a controlled dendritic microstructure.

Yet, it is another object of the invention to provide an improved method of casting an Al-Mg-Si alloy to provide dendritic cell spacing in the cast ingot in the range of 5 to 100 μm.

Yet it is still another object of the present invention to provide improved 6XXX series aluminum alloy products which exhibit higher strength levels while retaining favorable working and machining properties.

And still it is another object of the invention to provide improved 6XXX series aluminum alloy products which require little or no deformation to reach peak artificially aged properties.

These and other objects of the invention will become apparent from a reading of the specification, claims and figures appended hereto.

In accordance with these objects, there is provided an improved aluminum base alloy comprising an improved aluminum base alloy comprising 0.2 to 2 wt. % Si 0.3 to 1.7 wt. % Mg, 0 to 1.2 wt. % Cu, 0 to 1.1 wt. % Mn, 0.01 to 0.4 wt % Cr, and at least one of the elements selected from the group consisting of 0.01 to 0.3 wt. % V, 0.001 to 0.1 wt. % Be and 0.01 to 0.1 wt. % Sr, the remainder comprising aluminum, incidental elements and impurities.

The invention further comprises casting the alloy into an ingot, homogenizing the ingot and working it into a wrought product that is then solution heat treated and precipitation hardened or aged. The working may include rolling, forging, extruding or impact extruding the ingot. The ingot may be homogenized, solution heat treated and aged to the desired properties and thereafter machined or worked into a product. Products produced according to the invention have high strength levels while retaining good ductility.

DETAILED DESCRIPTION OF THE PREFERRED EMBODIMENTS

The alloys of the invention can comprise silicon, magnesium, copper and optionally, manganese, chromium, iron and titanium, and at least one of the elements selected from the group consisting of vanadium, beryllium and strontium, the balance comprising aluminum, incidental elements and impurities. Silicon can range from 0.2 to 2 wt. %, preferably 0.3 to 1.4 wt. % and typically 0.6 to 1.2 wt. %. All ranges provided herein include all of the numbers within the range as if specifically set forth therein. It will be appreciated that the subject invention contemplates many silicon ranges within these ranges, especially when other elements are used in conjunction with the silicon to provide for special properties. Magnesium can range from 0.3 to 1.7 wt. %, preferably 0.8 to 1.7 wt. % and typically 1 to 1.6 wt. %. Also, many ranges of magnesium are contemplated within these broad ranges depending on the amount of silicon and other elements present in the aluminum base alloy. Copper can range from 0 to 1.2 wt. %, preferably 0 to 0.9 wt. % and typically 0.4 to 1 wt. %. Manganese can range from 0 to 1.1 wt. %, preferably 0 to 0.8 wt. % and typically 0 to 0.6 wt. %. In certain alloys, it is desirable to maintain the level of manganese to a level of not greater than 0.2 wt. % and preferably less than 0.05 wt. %. Iron can range from 0 to 0.6 wt. %, preferably 0 to 0.4 wt. % and typically 0.15 to 0.35 wt. %. Chromium can be present to a max. of about 0.3 wt. % and preferably in the range of 0.05 to 0.3 wt. %. In the alloys of the invention, vanadium, when present, can range from 0.001 to 0.3 wt. %, preferably 0.01 to 0.3 wt. % and typically 0.10 to 0.25 wt. %. Further, beryllium, when present, can range from 0.001 to 0.1 wt. %, preferably 0.001 to 0.05 wt.

% and typically 0.001 to 0.02 wt. %. Also, strontium, when present, can range from 0.01 to 0.1 wt. %, preferably 0.01 to 0.05 wt. % and typically 0.02 to 0.05 wt. %. In the alloy, titanium can range from 0.01 to 0.20 wt. %, preferably, 0.01 to 0.10 wt. % and typically 0.02 to 0.05 wt. %. Zinc has a max. of 0.05 wt. %.

A preferred alloy in accordance with the invention can comprise 0.6 to 1.2 wt. % Si, 1 to 1.6 wt. % Mg, 0.4 to 1 wt. % Cu, 0.05 to 0.3 wt. % Cr, 0.15 to 0.35 wt. % Fe, at least one of the group consisting of 0.01 to 0.2 wt. % V, 0.001 to 0.05 wt. % Be and 0.01 to 0.1 wt. % Sr, max. 0.05 wt. % Mn, max. 0.05 wt. % Zn, max. 0.1 wt. % Ti, the remainder comprising aluminum, incidental elements and impurities.

In this class of aluminum alloys, Mg, Si and Cu are added mainly for increasing strength of such alloys.

Cr is present in the subject class of alloys mainly as a dispersoid for grain structure control. Other grain structure control materials include Mn, Fe and Zr.

V, Be and Sr are added for purposes of improvements in corrosion resistance, ductility and formability.

As well as providing the alloy product with controlled amounts of alloys elements as described hereinabove, it is preferred that the alloy be prepared according to specific method steps in order to provide the most desirable characteristics of strength, formability and ductility. Thus, the alloy as described herein can be provided as an ingot that may be homogenized, fabricated (hot or cold) without scalping, solution heat treated and aged prior to machining into a product. Further, the alloy may be roll cast or slab cast to thickness ranging from 0.1 to 3 inches or more depending on the end product. When it is desired to produce dish or cup-shaped containers, such as airbag containers, high pressure cylinders, baseball bats and the like, the alloy of the invention can be advantageously cast into small diameter ingots, e.g., 2 to 6-inch diameter or even larger diameter. Such diameter ingot in accordance with the invention can be cast at a rate or under conditions that permit control of the solidification rate or freeze rate of the small diameter ingot to provide a controlled microstructure. It is believed that the controlled microstructure, along with the alloy, permit remarkably improved properties in end products produced in accordance with the invention. By the term "mold" as used herein is meant to include any means used for solidifying aluminum base alloys, including but not limited to the casting means referred to herein.

Accordingly, such diameter ingots are advantageously produced using casting techniques described in U.S. Pat. Nos. 4,693,298 and 4,598,763, incorporated herein by reference. Such casting techniques can be employed to provide a solidification rate of 1° to 200° C./sec or 1° to 100° C./sec, preferably 2° to 25° C./sec and typically 2° to 10° C./sec, particularly in smaller diameter ingot. This method of casting can provide dendritic arm spacings in the range of 5 to 100 μm. Dendritic arm spacing is controlled by solidification rate.

The cast ingot, slab or sheet is preferably subjected to homogenization prior to the principal working operations. For purposes of homogenization, the cast material is heated to a temperature in the range of 900° to 1100° F. and preferably 1000° to 1070° F. for a period sufficient to dissolve soluble elements such as Mg, Si, Cu and homogenize the internal structure. Time at homogenization temperature can range from about 1 to 15 hours. Normally, the heat-up time and time at temperature does not extend more than 25 hours.

After homogenization, the metal can be rolled, extruded or forged directly into end products. Typically, a body of the alloy can be hot rolled to a sheet or plate product. Sheet thickness typically range from 0.020 to 0.2 inch, and plate thicknesses can range from 0.2 to 5 inches. For hot rolling, the temperatures typically range from 800° to 1025° F. For purposes of extrusion, the metal is heated to a temperature in the range of 750° to 1000° F. and extruded while the temperature is maintained above 750° F. Alternatively, the metal can be cold impact extruded into a cup-shaped container, for example.

The sheet, plate, extrusion or other worked article is solution heat treated to dissolve soluble elements. The solution heat treatment is preferably accomplished in a temperature range of 900° to 1085° F. and typically 1000° to 1070° F. The time at temperature for solution heat treating purposes can range from 2 to 12 hours. In certain instances, it may be desirable to control the heat-up rate to solution heat treating temperatures. After solution heat treating, the worked article may be rapidly quenched, e.g., cold water quench, to prevent or minimize uncontrolled precipitation of the strengthening phases. Thus, in the present invention, it is preferred to provide a quenching rate of at least 50° F. per second from 900° F. to about 400° F. or lower. A preferred quenching rate is about 100° F. per second.

After the alloy product of the present invention has been quenched, it may be subjected to a subsequent aging operation to provide for improved levels of strength that are desirable in the end product. Artificial aging can be accomplished by holding the quenched product in a temperature range of 200° to 450° F., preferably 300° to 400° F., for a time period sufficient to increase strength. Times for aging at these temperatures can range from 8 to 24 hours. A suitable aging practice includes a period of about 10 to 22 hours at a temperature of about 350° F.

Some compositions of the alloy product are capable of being artificially aged to tensile strengths of greater than 70 ksi. However, tensile strengths can range from about 55 to over 70 ksi, and yield strengths can range from about 50 to almost 68 ksi. Typically, elongation can range from about 8 to 18%.

With respect to aging, it should be noted that the alloy of the invention may be subjected to any of the typical under-aging or over aging treatments well known, including natural aging. In addition, the aging treatment may include multiple aging steps, such as two or three aging steps. Also, stretching or its equivalent working may be used prior to or even after part of the multiple aging steps. In the two or more aging steps, the first step may include aging at a relatively high temperature followed by a lower temperature or vice versa. For three-step aging, any combination of high and low temperatures may be employed.

For purposes of producing airbag propellant containers, for example, a suitable alloy contains 0.6 to 1.2 wt. % Si, 1 to 1.6 wt. % Mg, 0.4 to 1 wt. % Cu, 0.05 to 0.3 wt. % Cr, max. 0.05 wt. % Mn, max. 0.05 wt. % Zn, max. 0.1 wt. % Ti, 0.01 to 0.2 wt. % V and 0.001 to 0.05 wt. % Be. The alloy is typically cast into ingots having a diameter in the range of 3.5 to 4.5 inches. In casting, the molten alloy is solidified at a rate in the range of 2° to 25° C./sec. Preferably, the ingot produced has a dendritic cell spacing in the range of 5 to 50 μm. The ingot is homogenized in a temperature range of 1000° to 1070° F. for a period of 2 to 24 hours, and preferably, the ingot is cooled to a temperature range of 450° to 750° F. in a period of about 2 to 12 hours. Thereafter, the ingot can be air cooled to room temperature. The heat-up rate to homogenization temperature can be about 2° to 7° F./min. The ingot can be solution heat treated in a temperature range of 1030° F. to 1080° F. for about 1 to 3 hours, then rapidly quenched and aged at 325° to 365° F. for 12 to 20 hours. This provides an ingot having a tensile strength of 60 ksi and a yield strength of 55 ksi and an elongation of 10% without any hot or cold work.

The alloys and methods of the present invention can be best illustrated by the following examples which are intended to illustrate the present invention and to teach one of ordinary skill how to make and use the invention. They are not intended in any way to limit or narrow the scope of protection afforded by the claims.

EXAMPLE 1

An alloy having a nominal composition of 0.86 wt. % Si, 0.19 wt. % Fe, 0.81 wt. % Cu, 1.38 wt. % Mg and 0.23 wt. % Cr, the remainder being aluminum and incidental elements and impurities was cast into 4.1-inch diameter ingots by alloying and direct chill casting wherein the ingot was solidified at a rate of about 10° C./sec. The ingot had a dendritic cell spacing of 30 to 50 μm. The ingot was homogenized by being heated from ambient temperature to 1050° F. in about 1.5 hours, held at about 1055° F. for about 4 hours, and then still air cooled. The ingot was solution heat treated by being heated to a temperature of 1050° F. in about 1.5 hours, held at that temperature for about 2 hours, and then water quenched. The ingot was then precipitation hardened to a T6 condition by being held at a temperature of 350° F. for about 20 hours.

Portions of the ingot were then machined into test samples which were tested for tensile strength, yield strength and elongation according to conventional testing methods. The samples thus produced and tested exhibited a tensile strength of 62,000 psi, a yield strength of 55,000 psi and an elongation of 9%.

EXAMPLE 2

An alloy having a nominal composition of 0.89 wt. % Si, 0.19 wt. % Fe, 0.89 wt. % Cu, 1.45 wt. % Mg and 0.23 wt. % Cr, the remainder being aluminum and incidental elements and impurities was cast into 4.1-inch diameter ingots by alloying and direct chill casting wherein the ingot was solidified at a rate of about 10° C./sec. The ingot had a dendritic cell spacing of 30 to 50 μm. The ingot was homogenized by being heated from ambient temperature to 1050° F. in about 1.5 hours, held at about 1055° F. for about 4 hours, and then still air cooled. The ingot was solution heat treated by being heated to a temperature of 1050° F. in about 1.5 hours, held at that temperature for about 2 hours, and then water quenched. The ingot was then precipitation hardened to a T6 condition by being held at a temperature of 350° F. for about 20 hours.

A test specimen was then machined from the ingot and tested for tensile strength, yield strength and elongation according to conventional testing methods. The sample exhibited a tensile strength of 63,000 psi, a yield strength of 55,000 psi and an elongation of 8%.

EXAMPLE 3

An alloy having a nominal composition of 0.90 wt. % Si, 0.21 wt. % Fe, 0.83 wt. % Cu, 1.25 wt. % Mg, 0.23 wt. % Cr, 0.04 wt. % Sr, the remainder being aluminum and incidental elements and impurities was cast into 4.3-inch diameter ingots by alloying and direct chill casting wherein the ingot was solidified at a rate of about 10° C./sec. The ingot had a dendritic cell spacing of 30 to 50 μm. The ingot was homogenized by being heated from ambient temperature to 1060° F. in about 1.5 hours, held at about 1060° F. for about 4 hours, and then still air cooled. The ingot was solution heat treated by being heated to a temperature of 1060° F. in about 1.5 hours, held at that temperature for about 2 hours, and then water quenched. The ingot was then precipitation hardened to a T6 condition by being held at a temperature of 350° F. for about 20 hours.

A test specimen was then machined from the ingot and tested for tensile strength, yield strength and elongation according to conventional testing methods. The samples thus produced and tested exhibited a tensile strength of 63,000 psi, an ultimate yield strength of 58,000 psi and an elongation of 8%.

EXAMPLE 4

An alloy having a nominal composition of 0.83 wt. % Si, 0.17 wt. % Fe, 0.77 wt. % Cu, 1.45 wt. % Mg, 0.20 wt. % Cr, 0.02 wt. % Sr, the remainder being aluminum and incidental elements and impurities was cast into 4.1-inch diameter ingots by alloying and direct chill casting wherein the ingot was solidified at a rate of 10° C./sec. The ingot had a dendritic cell spacing of 30 to 50 μm. The ingot was homogenized by being heated from ambient temperature to 1055° F. in about 4 hours, held at about 1055° F. for about 8 hours, and then fan cooled. The ingot was then solution heat treated by being heated to a temperature of 1055° F. in about 1.5 hours, held at that temperature for about 2 hours, and then water quenched. The ingot was then precipitation hardened to a T6 condition by being held at a temperature of 350° F. for about 20 hours.

A test specimen was then machined from the ingot and tested for tensile strength, yield strength and elongation according to conventional testing methods. The specimen exhibited a tensile strength of 60,000 psi, a yield strength of 55,000 psi and an elongation of 12%.

EXAMPLE 5

An alloy having a nominal composition of 0.83 wt. % Si, 0.17 wt. % Fe, 0.77 wt. % Cu, 1.33 wt. % Mg, 0.20 wt. % Cr, 0.11 wt. % V, 0.007 wt. % Be, and 0.04 wt. % Sr, the remainder being aluminum and incidental elements and impurities was cast into 4.1-inch diameter ingots by alloying and direct chill casting wherein the ingot was solidified at a rate of about 10° C./sec. The ingot had a dendritic cell spacing of 30 to 50 μm. The ingot was homogenized by being heated from ambient temperature to 1055° F. in about 4 hours, held at about 1055° F. for about 8 hours, and then fan cooled. The ingot was solution heat treated by being heated to a temperature of 1055° F. in about 1.5 hours, held at that temperature for about 2 hours, and then water quenched. The ingot was then precipitation hardened to a T6 condition by being held at a temperature of 350° F. for about 20 hours.

Portions of the ingot were then formed into test samples which were tested for tensile strength, yield strength and elongation. The test samples exhibited a tensile strength of 60,000 psi, a yield strength of 52,000 psi and an elongation of 10%.

EXAMPLE 6

An alloy having a nominal composition of 0.91 wt. % Si, 0.17 wt. % Fe, 0.78 wt. % Cu, 1.41 wt. % Mg, 0.22 wt. % Cr, 0.1 wt. % V, 0.006 wt. % Be, the remainder being aluminum and incidental elements and impurities was cast into 4.3-inch diameter ingots by alloying and direct chill casting wherein the ingot was solidified at a rate of about 10° C./sec. The ingot had a dendritic cell spacing of 30 to 50 μm. The ingot was homogenized by being heated from ambient temperature to 1055° F. in about 4 hours, held at about 1055° F. for about 8 hours, and then fan cooled. The ingot was then hot extruded at 850° F. into a hollow cylinder having a 4.3-inch outer diameter and a ¼-inch wall thickness. The tube was solution heat treated by being heated to 1055° F. in about 1.5 hours, held at that temperature for about 2 hours, and then water quenched. The tube was then precipitation hardened to a T6 condition by being held at a temperature of 350° F. for about 16 hours.

Portions of the tube were then machined into test samples which in turn were tested for tensile strength, yield strength and elongation according to conventional testing methods. The samples exhibited a tensile strength of 60,000 psi, a yield strength of 55,000 psi and an elongation of 14%.

EXAMPLE 7

An alloy having a nominal composition of 0.91 wt. % Si, 0.17 wt. % Fe, 0.78 wt. % Cu, 1.41 wt. % Mg, 0.22 wt. % Cr, 0.1 wt. % V, 0.006 wt. % Be, the remainder being aluminum and incidental elements and impurities was cast into 4.1-inch diameter ingots by alloying and direct chill casting wherein the ingot was solidified at a rate of about 10° C./sec. The ingot had a dendritic cell spacing of 30 to 50 μm. The ingot was homogenized by being heated from ambient temperature to 1055° F. in about 4 hours, held there for about 8 hours, and then fan cooled. The ingot was then hot extruded into a hollow 1-inch square tube having a ⅛-inch wall thickness using a port hole die. The tube was then solution heat treated by being heated to 1055° F. in about 1.5 hours, held at that temperature for about 2 hours, and then water quenched. The tube was then precipitation hardened to a T6 condition by being held at a temperature of 350° F. for about 16 hours.

Portions of the tube were then machined into test samples which in turn were tested for tensile strength, yield strength and elongation according to conventional testing methods. The samples thus produced and tested exhibited a tensile strength of 55,000 psi, a yield strength of 52,000 psi and an elongation of 10%.

EXAMPLE 8

An alloy having a nominal composition of 0.91 wt. % Si, 0.17 wt. % Fe, 0.78 wt. % Cu, 1.41 wt. % Mg, 0.22 wt. % Cr, 0.1 wt. % V, 0.006 wt. % Be, the remainder being aluminum and incidental elements and impurities was cast into 4.1-inch diameter ingots by alloying and direct chill casting wherein the ingot was solidified at a rate of about 10° C./sec. The ingot had a dendritic cell spacing of 30 to 50 μm. The ingot was homogenized by being heated from ambient temperature to 1055° F. in about 4 hours, held at about 1055° F. for about 8 hours, cooled to 600° F. in 5 hours, held at 600° F. for hours, then fan cooled to room temperature in 2 hours. The ingot was then cold impact extruded into a 2-inch long hollow, flat-bottomed canister having a 3.6-inch outer diameter and a ⅛-inch wall thickness. The canister was solution heat treated by being heated to 1055° F. in about 1.5 hours, held at that temperature for about 2 hours, and then water quenched. The canister was finally precipitation hardened to a T6 condition by being held at a temperature of 350° F. for about 16 hours.

Sidewall portions of the canister were then machined into test samples which in turn were tested for tensile strength, yield strength and elongation according to conventional testing methods. The samples exhibited a tensile strength of about 64,000 psi, a yield strength of 59,000 psi and an elongation of 18%.

EXAMPLE 9

An alloy having a nominal composition of 0.91 wt. % Si, 0.17 wt. % Fe, 0.78 wt. % Cu, 1.41 wt. % Mg, 0.22 wt. % Cr, 0.1 wt. % V, and 0.006 wt. % Be, the remainder being aluminum and incidental elements and impurities was cast into 4.1-inch diameter ingots by alloying and direct chill casting wherein the ingot was solidified at a rate of about 10° C./sec. The ingot had a dendritic cell spacing of 30 to 50 μm. The ingot was homogenized by being heated from ambient temperature to 1055° F. in about 4 hours, held at about 1055° F. for about 8 hours, and then fan cooled. The ingot was then hot extruded at 950° F. into a 1-inch diameter solid round bar. The solid bar was solution heat treated by being heated to a temperature of 1055° F. in about 1.5 hours, held at that temperature for about 2 hours, and then water quenched. The solid bar was then precipitation hardened to a T6 condition by being held at a temperature of 350° F. for about 16 hours.

Portions of the solid bar were then machined into test samples which in turn were tested for tensile strength, yield strength and elongation according to conventional testing methods. The test samples thus produced and tested exhibited a longitudinal tensile strength of 72,000 psi, a yield strength of 68,000 psi and an elongation of 12%. Transverse properties were 64,000 psi tensile, 58,000 psi yield and 13% elongation.

EXAMPLE 10

An alloy having a nominal composition of 0.84 wt. % Si, 0.17 wt. % Fe, 0.77 wt. % Cu, 1.45 wt. % Mg, 0.20 wt. % Cr, 0.02 wt. % Sr, the remainder being aluminum and incidental elements and impurities was cast into 4.1-inch diameter ingots by alloying and direct chill casting wherein the ingot was solidified at a rate of about 10° C./sec. The ingot had a dendritic cell spacing of 30 to 50 μm. The ingot was homogenized by being heated from ambient temperature to 1055° F. in about 4 hours, held there for about 8 hours, and then fan cooled. The ingot was then hot extruded at 950° F. into a 1-inch diameter solid round bar. The solid bar was solution heat treated by being heated to 1055° F. in about 1.5 hours, held for about 2 hours, and then water quenched. The solid bar was then precipitation hardened to a T6 condition by being held at a temperature of 350° F. for about 16 hours.

Portions of the solid bar were then machined into test samples which were tested for tensile strength, yield strength and elongation. The test samples thus produced and tested exhibited a longitudinal tensile strength of 71,000 psi, a longitudinal yield strength of about 67,000 psi and a longitudinal elongation of about 12%. The samples demonstrated transverse properties of about 63,000 psi tensile, 56,000 psi yield and 14% elongation.

The composition and test data for the examples are summarized below in Tables 1 and 2. Table 3 summarizes compositions and properties of three known 6XXX alloys.

TABLE 1

| Example | No. | Si | Fe | Cu | Mg | Cr | V | Be | Sr |
|---|---|---|---|---|---|---|---|---|---|
| 1 | (DF6C-1) | .86 | .19 | .81 | 1.38 | .23 | — | — | — |
| 2 | (DF6C-2) | .89 | .19 | .89 | 1.45 | .23 | — | — | — |
| 3 | (DF6C-3) | .90 | .21 | .83 | 1.25 | .23 | — | — | 0.04 |
| 4, 10 | (DF6C-4) | .83 | .17 | .77 | 1.45 | .20 | — | — | 0.02 |
| 5 | (DF6C-6) | .83 | .17 | .77 | 1.33 | .20 | .11 | .007 | 0.04 |
| 6, 7, 8, 9 | (DF6C-5) | .91 | .17 | .78 | 1.41 | .22 | .1 | .006 | — |

TABLE 2

| Example | No. | Tensile (ksi) | Yield (ksi) | Elong. (%) |
|---|---|---|---|---|
| 1 | DF6C-1 (ingot, T6) No deformation | 62 | 55 | 9 |
| 2 | DF6C-2 (ingot, T6) No deformation | 63 | 55 | 8 |
| 3 | DF6C-3 (ingot, T6) No deformation | 63 | 58 | 8 |
| 4 | DF6C-4 (ingot, T6) No deformation | 60 | 55 | 12 |
| 5 | DF6C-5 & 6 (ingot, T6) No deformation | 60 | 52 | 10 |
| 6 | DF6C-5 Extru. 4.3" round hollow cylinder (hot impact extruded-¼" wall, T6) | 60 | 55 | 14 |
| 7 | DF6C-5 Extru. 1" sq. hollow tube (hot extruded-⅛" wall, T6) | 55 | 52 | 10 |
| 8 | DF6C-5 (canister, ⅛" wall, T6) 3.6" round (cold impact extruded) | 64 | 59 | 18 |
| 9 | DF6C-5 (bar, T6) *1" round solid | 72 | 68 | 12 |
| 10 | DF6C-4 (bar, T6) *1" round solid | 71 | 67 | 12 |

*(hot extruded) properties confirmed in triplicate

TABLE 3

| Alloy | Si | Cu | Mg | Cr | Mn | Tensile (ksi) | Yield (ksi) | Elong. (%) |
|---|---|---|---|---|---|---|---|---|
| 6061, T6 | .6 | .25 | 1.0 | .20 | — | 45 | 40 | 12 |
| 6066, T6 | 1.3 | 1.0 | 1.1 | — | .8 | 57 | 52 | 12 |
| 6070, T6 | 1.3 | 2.8 | .8 | — | .7 | 55 | 51 | 10 |
| 6013, T6 | .8 | .8 | 1.0 | — | .5 | 55 | 50 | 8 |

Referring to Tables 1, 2 and 3 and the examples, Examples 1 and 2 demonstrate the increased strength which can be achieved with higher levels of Mg, Si and Cu compared to known 6XXX alloys. Examples 3–5 demonstrate that very high strength levels can now be achieved using compositions and methods of the present invention. Example 3 demonstrates the increased strength achieved by addition of Sr. Examples 4 and 5 demonstrate the high strength levels and favorable elongation properties exhibited by alloys containing V and Be according to the present invention. In particular, the alloy of Example 4 demonstrates generally significantly higher tensile and yield strengths than 6061 T6, 6066 T6, 6070 T6 and 6013 T6 wrought products, yet shows no decrease in elongation. The alloy of Examples 9 and 10 demonstrates significantly higher tensile and yield strengths than published non-cold-worked 6XXX alloys, while retaining equal elongation properties. This result is unexpected and is attributed to the discovery that the addition of one of V, Be or Sr to the above-mentioned alloys provides these unexpected improvements.

Examples 6 and 8 demonstrate the further improvement in properties of alloys according to the present invention resulting from deformation by hot extrusion and cold impact extrusion. In Example 6, hot extrusion of the alloy into a hollow cylinder with ¼-inch walls resulted in further improvements in tensile and yield strengths as well as elongation. In Example 8, cold impact extrusion of the alloy into a hollow canister having ⅛-inch walls resulted in greatly increased yield and elongation with only a very small decrease in tensile strength, which nonetheless was very high for a 6XXX alloy. The alloy of Example 7 was similar in all regards to that of Examples 6 and 8 except that it was hot extruded into a square tube having a ⅛-inch wall thickness. After deformation, the alloy of Example 7 showed decreased tensile strength, yield and elongation compared to the same alloy without deformation (Example 4).

The alloy in accordance with the invention can be used for sheet, plate, forged or extruded components in a broad range of applications, including high pressure cylinders; sports equipment such as ski poles, baseball bats; automotive applications such as suspension components, drive shafts and yokes, steering system components, bumpers, impact protection beams, door stiffeners, space frames and vehicular panels, including floor panels, side panels and the like.

By the foregoing examples, it will be readily apparent to those skilled in the art that the invention can be modified in arrangement and detail without departing from such principles. Further, the foregoing examples are intended to illustrate and explain the invention and not to limit the scope of the following claims.

What is claimed is:

1. A method of casting an aluminum base alloy to provide a cast product having a controlled dendritic microstructure, the method comprising the steps of:

(a) providing a body of a molten aluminum base alloy containing 0.2 to 2 wt. % Si, 0.3 to 1.7 wt. % Mg, 0.5 1 to 1.2 wt. % Cu, less than about 0.05 wt. % Mn, 0.05 to 0.4 wt. % Cr, 0.1 to 0.4 wt. % Fe, max. 0.2 wt. % Ti, max., less than 0.05 wt. % Zn, and at least one of the elements selected from the group consisting of 0.01 to 0.3 wt. % V, 0.001 to 0.1 wt. % Be and 0.01 to 0.1 wt. % Sr, the remainder comprising aluminum, incidental elements and impurities;

(b) introducing said molten aluminum base alloy to a mold; and (c) continuously solidifying said molten aluminum base alloy in said mold to provide a cast product, the molten alloy being solidified at a rate 1° to 100° C./second to provide a dendritic cell spacing in the range of 5 to 100 μm in said cast product.

2. The method in accordance with claim 1 wherein silicon is maintained in the range of 0.3 to 1.4 wt. %.

3. The alloy in accordance with claim 1 wherein silicon is maintained in the range of 0.6 to 1.2 wt. %.

4. The method in accordance with claim 1 wherein magnesium is maintained in the range of 0.8 to 1.7 wt. %.

5. The alloy in accordance with claim 1 wherein magnesium is maintained in the range of 1 to 1.6 wt. %.

6. The method in accordance with claim 1 wherein copper is maintained in the range of 0.51 to 1 wt. %.

7. The method in accordance with claim 1 wherein chromium is maintained in the range of 0.05 to 0.3 wt. %.

8. A method of casting an aluminum base alloy to provide a cast product having a controlled dendritic microstructure, the method comprising the steps of:

(a) providing a body of a molten aluminum base alloy containing 0.6 to 1.2 wt. % Si, 1 to 1.6 wt. % Mg, 0.4 to 1 wt. % Cu, max. 0.05 wt. % Mn, 0.05 to 0.3 wt. %

Cr, and at least one of the elements selected from the group consisting of 0.01 to 0.3 wt. % V, 0.001 to 0.05 wt. % Be and 0.01 to 0.1 wt. % Sr, the remainder comprising aluminum, incidental elements and impurities;

(b) introducing said molten aluminum base alloy to a mold; and (c) continuously solidifying said molten aluminum base alloy in said mold to provide a cast product, the molten alloy being solidified at a rate 2° to 25° C./second to provide a dendritic cell spacing in the range of 15 to 50 μm in said cast product.

9. A method of producing a wrought aluminum alloy, heat treated product having improved levels of strength and formability, the method comprising the steps of:

(a) casting a body of an aluminum base alloy consisting essentially of 0.2 to 2 wt. % Si, 0.3 to 1.7 wt. % Mg, 0.51 to 1.2 wt. % Cu, less than about 0.05 wt. % Mn, 0.05 to 0.4 wt. % Cr, 0.1 to 0.4 wt. % Fe, max. 0.2 wt. % Ti, less than 0.05 wt. % Zn, and at least one of the elements selected from the group consisting of 0.01 to 0.3 wt. % V, 0.001 to 0.1 wt. % Be and 0.01 to 0.1 wt. % Sr, the remainder comprising aluminum, incidental elements and impurities, the body being solidified at a rate of 1° to 100° C./sec and to produce a dendritic cell spacing in the range of 5 to 100 μm;

(b) homogenizing said body;

(c) working said body;

(d) solution heat treating said worked body; and (e) artificial aging said solution heat treated product to a tensile strength in the range of 55 to greater than 70 ksi.

10. The method in accordance with claim 9 wherein said body is homogenized by treating for 2 to 24 hours in a temperature range of 1000° to 1075° F. followed by treating for 2 to 12 hours in a temperature range of 450° to 750° F.

11. The method in accordance with claim 9 wherein said body is hot worked in a temperature range of 750° to 1025° F.

12. The method in accordance with claim 9 wherein said worked body is solution heat treated in a temperature range of 900° to 1070° F.

13. The method in accordance with claim 9 wherein said solution heat treated body is artificially aged in a temperature range of 200° to 450° F.

14. The method in accordance with claim 9 wherein said solution heat treated body is aged to a T6 temper.

15. A method of producing a wrought aluminum alloy, heat treated product having improved levels of strength and formability, the method comprising the steps of:

(a) casting a body of an aluminum base alloy consisting essentially of 0.6 to 1.2 wt. % Si, 1 to 1.6 wt. % Mg, 0.51 to 1 wt. % Cu, max. 0.05 wt. % Mn, 0.05 to 0.3 wt. % Cr, 0.1 to 0.4 wt. % Fe, max. 0.2 wt. % Ti, less than 0.05 wt. % Zn, and at least one of the elements selected from the group consisting of 0.01 to 0.3 wt. % V, 0.001 to 0.05 wt. % Be and 0.01 to 0.1 wt. % Sr, the remainder comprising aluminum, incidental elements and impurities, the body being solidified at a cooling rate of 2° to 25° C./sec to produce a dendritic cell spacing in the range of 15 to 50 μm;

(b) homogenizing said body;

(c) working said body;

(d) solution heat treating said worked body; and (e) artificial aging said solution heat treated product to a tensile strength in the range of 55 to greater than 70 ksi.

16. The method in accordance with claim 15 wherein said body is homogenized by treating for 2 to 24 hours in a temperature range of 1000° to 1075° F. followed by treating for 2 to 12 hours in a temperature range of 450° to 750° F.

17. The method in accordance with claim 15 wherein said body is hot worked in a temperature range of 750° to 1025° F.

18. The method in accordance with claim 15 wherein said worked body is solution heat treated in a temperature range of 1000° to 1070° F.

19. The method in accordance with claim 15 wherein said solution heat treated body is artificially aged in a temperature range of 200° to 450° F.

20. The method in accordance with claim 15 wherein said solution heat treated body is aged to a T6 temper.

21. The method in accordance with claim 15 wherein said hot working is hot extruding.

22. The method in accordance with claim 15 wherein said hot working is hot rolling.

23. The method in accordance with claim 15 wherein said hot working is hot forging.

24. A method of producing an aluminum base alloy, heat treated cast product having improved levels of strength and ductility, the method comprising the steps of:

(a) providing a body of an aluminum base alloy consisting essentially of 0.2 to 2 wt. % Si, 0.3 to 1.7 wt. % Mg, 0.51 to 1.2 wt. % Cu, less than about 0.05 wt. % Mn, 0.05 to 0.4 wt. % Cr, max. 0.4 wt. % Fe, max. 0.2 wt. % Ti, less than 0.05 wt. % Zn, and at least one of the elements selected from the group consisting of 0.01 to 0.3 wt. % V, 0.001 to 0.1 wt. % Be and 0.01 to 0.1 wt. % Sr, the remainder comprising aluminum, incidental elements and impurities;

(b) homogenizing said body by first treating said body for 2 to 24 hours in a temperature range of 900° to 1075° F. followed by bringing said body into a temperature range of about 450° to 750° F. for a period of about 2 to 12 hours;

(c) then solution heat treating said body; and (d) aging said body to a tensile strength in the range of 55 to greater than 70 ksi to provide said cast product.

25. The method in accordance with claim 24 wherein said body is homogenized by first treating in a temperature range of 1000° to 1070° F.

26. The method in accordance with claim 24 wherein in step (b) after the first treating at 900° to 1075° F., the body is brought to a temperature range of 550° to 750° F.

27. The method in accordance with claim 24 wherein said body is solution heat treated in a temperature range of 750° to 1025° F.

28. The method in accordance with 24 wherein said solution heat treated body is aged in a temperature range of 250° to 450° F. for a period of 8 to 24 hours.

29. The method in accordance with claim 24 wherein said solution heat treated body is aged to a T6 temper.

30. The method in accordance with claim 24 wherein said alloy comprises 0.6 to 1.2 wt. % Si, 1 to 1.6 wt % Mg, 0.51 to 1 wt. % Cu, max. 0.05 wt. % Mn, 0.05 to 0.3 wt. % Cr, and at least one of the elements selected from the group consisting of 0.01 to 0.3 wt. % V, 0.001 to 0.05 wt. % Be and 0.01 to 0.1 wt. % Sr, the remainder comprising aluminum, incidental elements and impurities.

31. The method in accordance with claim 24 wherein said body is aged to a tensile strength of at least 60 ksi and an elongation of at least 10%.

32. A method of producing an aluminum base alloy, heat treated ingot having improved levels of strength and ductility, the method comprising the steps of:

(a) casting an ingot of an aluminum base alloy consisting essentially of 0.2 to 2 wt. % Si, 0.3 to 1.7 wt. % Mg, 0.51 to 1.2 wt. % Cu, less than about 0.05 wt. % Mn, 0.05 to 0.4 wt. % Cr, 0.1 to 0.4 wt. % Fe, max. 0.2 wt. % Ti, less than 0.05 wt. % Zn, and at least one of the elements selected from the group consisting of 0.01 to 0.3 wt. % V, 0.001 to 0.1 wt. % Be and 0.01 to 0.1 wt. % Sr, the remainder comprising aluminum, incidental elements and impurities, the ingot being solidified at a cooling rate of 1° to 100° C./sec to produce a dendritic cell spacing in the range of 5 to 100 μm;

(b) homogenizing said body by first treating said ingot for 2 to 24 hours in a temperature range of 900° to 1075° F. followed by bringing said ingot into a temperature range of about 450° to 750° F. for a period of about 2 to 12 hours;

(c) then solution heat treating said ingot; and (d) aging said ingot to a tensile strength in the range of 55 to greater than 70 ksi to provide said cast product.

33. The method in accordance with claim 32 wherein the dendritic cell spacing is in the range of 15 to 50 μm.

34. The method in accordance with claim 32 including the step of solidifying said ingot at a rate in the range of 1°to 200° C./sec.

35. The method in accordance with claim 32 including the step of solidifying said ingot at a rate in the range of 2° to 25° C./sec.

36. The method in accordance with claim 32 including the step of solidifying said ingot at a rate in the range of 2 to 10° C./sec.

37. The method in accordance with claim 32 wherein said ingot is homogenized by first treating in a temperature range of 1000° to 1070° F.

38. The method in accordance with claim 32 wherein in step (b) after the first treating at 900° to 075° F., the ingot is brought to a temperature range of 500° to 750° F.

39. The method in accordance with claim 24 wherein said body is solution heat treated in a temperature range of 1000° to 1070° F.

40. The method in accordance with claim 24 wherein said body is aged in a temperature range of 200° to 400° F. for a period of 2 to 24 hours.

41. The method in accordance with claim 32 wherein said alloy comprises 0.6 to 1.2 wt. % Si, 1 to 1.6 wt. % Mg, 0.51 to 1 wt. % Cu, max. 0.05 wt. % Mn, 0.05 to 0.3 wt. % Cr, and at least one of the elements selected from the group consisting of 0.01 to 0.3 wt. % V, 0.001 to 0.05 wt. % Be and 0.01 to 0.1% wt. % Sr, the remainder comprising aluminum, incidental elements and impurities.

42. An improved aluminum alloy, direct chill cast product capable of being aged to a T6 temper, the cast product cooled at a rate of 1° to 200° C./sec and having a dendritic cell spacing in the range of 5 to 100 μm, the cast product consisting essentially of 0.2 to 2 wt. % Si, 0.3 to 1.7 wt. % Mg, 0.51 to 1.2 wt. % Cu, less than about 0.05 wt. % Mn, 0.05 to 0.4 wt. % Cr, 0.1 to 0.4 wt. % Fe, max. 0.2 wt. % Ti, less than 0.05 wt. % Zn, and at least one of the elements selected from the group consisting of 0.01 to 0.3 wt. % V, 0.001 to 0.1 wt. % Be and 0.01 to 0.1 wt. % Sr, the remainder comprising aluminum, incidental elements and impurities, the cast product, after homogenization, solution heat treatment and aging to a T6 condition, having a tensile strength of at least 60 ksi and an elongation of at least 10%.

43. The alloy in accordance with claim 42 wherein silicon is maintained in the range of 0.3 to 1.4 wt. %.

44. The alloy in accordance with claim 42 wherein silicon is maintained in the range of 0.6 to 1.2 wt. %.

45. The alloy in accordance with claim 42 wherein magnesium is maintained in the range of 0.8 to 1.7 wt. %.

46. The alloy in accordance with claim 42 wherein magnesium is maintained in the range of 1 to 1.6 wt. %.

47. The alloy in accordance with claim 42 wherein copper is maintained in the range of 0.51 to 1 wt. %.

48. The alloy in accordance with claim 42 wherein chromium is maintained in the range of 0.05 to 0.3 wt. %.

49. An improved aluminum alloy, direct chill cast product capable of being aged to a T6 temper, the cast product cooled at a rate of 1° to 100° C./sec and having a dendritic cell spacing in the range of 5 to 100 μm, the cast product consisting essentially of 0.6 to 1.2 wt. % Si, 1 to 1.6 wt. % Mg, 0.51 to 1 wt. % Cu, max. 0.05 wt. % Mn, 0.05 to 0.3 wt. % Cr, 0.1 to 0.4 wt. % Fe, max. 0.2 wt. % Ti, less than 0.05 wt. % Zn, and at least one of the elements selected from the group consisting of 0.01 to 0.3 wt. % V, 0.001 to 0.05 wt. % Be and 0.01 to 0.1 wt. % Sr, the remainder comprising aluminum, incidental elements and impurities, the cast product, after homogenization, solution heat treatment and aging to a T6 condition, having a tensile strength of at least 60 ksi and an elongation of at least 10%.

50. An improved aluminum alloy cast product, the cast product having a dendritic cell spacing in the range of 5 to 100 μm, the cast product comprising 0.2 to 2 wt. % Si, 0.3 to 1.7 wt. % Mg, 0.51 to 1.2 wt. % Cu, less than about 0.05 wt. % Mn, 0.01 to 0.4 wt. % Cr, and at least one of the elements selected from the group consisting of 0.01 to 0.3 wt. % V, 0.001 to 0.1 wt. % Be and 0.01 to 0.1 wt. % Sr, the remainder comprising aluminum, incidental elements and impurities, the product having a tensile strength of at least 60 ksi and an elongation of at least 10% in the T6 condition.

51. The cast product in accordance with claim 50 wherein the dendritic cell spacing is in the range of 15 to 50 μm.

52. An improved aluminum alloy cast product, the cast product having a dendritic cell spacing in the range of 5 to 100 μm, the cast product comprising 0.2 to 2 wt. % Si, 0.3 to 1.7 wt. % Mg, 0.51 to 1.2 wt. % Cu, less than about 0.05 wt. % Mn, 0.01 to 0.4 wt. % Cr, and at least one of the elements selected from the group consisting of 0.01 to 0.1 wt. % Sr, the remainder comprising aluminum, incidental elements and impurities, the product having a tensile strength of at least 60 ksi and an elongation of at least 10% in the T6 condition.

53. The cast product in accordance with claim 52 wherein the dendritic cell spacing is in the range of 15 to 50 μm.

54. An improved aluminum alloy cast product, the cast product solidified at a cooling rate of 1° to 100° C./sec and having a dendritic cell spacing in the range of 5 to 100 μm, the cast product consisting essentially of 0.6 to 1.2 wt. % Si, 1 to 1.6 wt. % Mg, 0.51 to 1 wt. % Cu, max. 0.05 wt. % Mn, 0.05 to 0.3 wt. % Cr, 0.1 to 0.4 wt. % Fe, max. 0.2 wt,% Ti, less than 0.05 wt. % Zn, and at least one of the elements selected from the group consisting of 0.01 to 0.3 wt. % V, 0.001 to 0.05 wt. % Be and 0.01 to 0.1 wt. % Sr, the remainder comprising aluminum incidental elements and impurities, the product having a tensile strength of at least 60 ksi and an elongation of at least 10% in the T6 condition.

55. The cast product in accordance with claim 54 wherein the dendritic cell spacing is in the range of 15 to 50 μm.

56. An improved aluminum base alloy ingot solidified at a cooling rate of 1° to 100° C./sec and having a dendritic cell spacing in the range of 5 to 100 μm, the ingot consisting essentially of 0.2 to 2 wt. % Si, 0.3 to 1.7 wt. % Mg, 0.51 to 1.2 wt. % Cu, less than about 0.05 wt. % Mn, 0.01 to 0.4 wt. % Cr, max. 0.4 wt. % Fe, max. 0.2 wt. % Ti, less than 0.05 wt. % Zn, and at least one of the elements selected from the group consisting of 0.01 to 0.3 wt. % V, 0.001 to 0.1 wt. % Be and 0.01 to 0.1 wt. % Sr, the remainder comprising aluminum, incidental elements and impurities, the ingot having a tensile strength of at least 60 ksi and an elongation of at least 10% in the T6 condition.

57. The ingot in accordance with claim 56 wherein the dendritic cell spacing is in the range of 15 to 50 μm.

58. An improved aluminum base alloy ingot solidified at a cooling rate of 1° to 100° C./sec and having a dendritic cell spacing in the range of 15 to 50 μm, the ingot consisting essentially of 0.6 to 1.2 wt. % Si, 1 to 1.6 wt. % Mg, 0.51 to 1 wt. % Cu, max. 0.05 wt. % Mn, 0.05 to 0.3 wt. % Cr, max. 0.4 wt. % Fe, max. 0.2 wt. % Ti, less than 0.05 wt. % Zn, and at least one of the elements selected from the group consisting of 0.01 to 0.3 wt. % V, 0.001 to 0.05 wt. % Be and 0.01 to 0.1 wt. % Sr, the remainder comprising aluminum, incidental elements and impurities, the ingot having a tensile strength of at least 60 ksi and an elongation of at least 10% in the T6 condition.

* * * * *